US005356746A

United States Patent [19]

Sugiyama et al.

[11] Patent Number: 5,356,746

[45] Date of Patent: Oct. 18, 1994

[54] ELECTROPHOTOGRAPHIC PHOTOSENSITIVE MEMBER, ELECTROPHOTOGRAPHIC APPARATUS, DEVICE UNIT AND FACSIMILE MACHINE

[75] Inventors: Satomi Sugiyama, Kawasaki; Yoshio Kashizaki, Yokohama; Koichi Suzuki, Kawasaki; Shintetsu Go, Yokohama, all of Japan

[73] Assignee: Canon Kabushiki Kaisha, Tokyo, Japan

[21] Appl. No.: 961,384

[22] Filed: Oct. 15, 1992

[30] Foreign Application Priority Data

Oct. 15, 1991 [JP] Japan ..... 3-293901

[51] Int. Cl.[5] ..... G03G 5/06

[52] U.S. Cl. ..... 430/73; 430/76

[58] Field of Search ..... 430/45, 73, 76

[56] References Cited

U.S. PATENT DOCUMENTS

| | | | |
|---|---|---|---|
| 3,723,113 | 3/1973 | Gotte | 430/45 |
| 4,975,349 | 12/1990 | Kashizaki | 430/58 |
| 5,093,218 | 3/1992 | Miyaji et al. | 430/58 |
| 5,158,847 | 10/1992 | Go et al. | 430/58 |

FOREIGN PATENT DOCUMENTS

| | | |
|---|---|---|
| 394142 | 10/1990 | European Pat. Off. . |
| 72-08632 | 11/1972 | France . |
| 50-156940 | 12/1975 | Japan . |
| 57-138646 | 8/1982 | Japan . |
| 57-202349 | 12/1982 | Japan . |
| 63-282743 | 11/1988 | Japan . |
| 1325974 | 8/1973 | United Kingdom . |

OTHER PUBLICATIONS

Chem. Abstracts, vol. 84, No. 24, 1976, Abst. No. 172164g of Japanese Kokoi 75-156, 940.

*Primary Examiner*—John Goodrow

*Attorney, Agent, or Firm*—Fitzpatrick, Cella, Harper & Scinto

[57] ABSTRACT

An electrophotographic photosensitive member, comprising: an electroconductive support and a photosensitive layer disposed on the electroconductive support, wherein the photosensitive layer comprises a triazene compound represented by the following formula (1):

$$-N{=}N{-}\overset{\overset{\displaystyle R}{|}}{N}{-}, \qquad (1)$$

wherein R denotes hydrogen, a substituted or unsubstituted alkyl group, a substituted or unsubstituted aryl group, or a substituted or unsubstituted aralkyl group.

11 Claims, 1 Drawing Sheet

ELECTROPHOTOGRAPHIC PHOTOSENSITIVE MEMBER, ELECTROPHOTOGRAPHIC APPARATUS, DEVICE UNIT AND FACSIMILE MACHINE

FIELD OF THE INVENTION AND RELATED ART

The present invention relates to an electrophotographic photosensitive member, particularly to an electrophotographic photosensitive member having a photosensitive layer containing a specific triazene compound.

The present invention also relates to an electrophotographic apparatus, a device unit and a facsimile machine respectively using the electrophotographic photosensitive member.

Hitherto, there have been proposed organic photoconductive materials to be used for electrophotographic photosensitive members, which include organic photoconductive polymers such as polyvinyl carbazole; and low-molecular weight organic photoconductive materials such as 2,5-bis(p-diethylaminophenol)-1,3,4-oxadiazole; and those comprising the above-mentioned organic photoconductive materials and various dyes or pigments in combination.

The above-mentioned photosensitive members employing the organic photoconductive materials have advantages in that the photosensitive members may easily be produced, are relatively inexpensive and are allowed to readily control a wavelength region having sensitivity (or photosensitivity) by appropriately selecting dyes or pigments used. Thus, many photosensitive members employing organic photoconductive materials have heretofore been proposed. Particularly, there has been proposed a photosensitive member having a laminate-type structure, wherein a photosensitive layer comprises a charge generation layer containing a charge-generating material such as organic photoconductive dyes or pigments and a charge transport layer containing a charge-transporting material (i.e., so-called "function-separation type photosensitive member"). Such a function-separation type photosensitive member has brought about a considerable improvement on a conventional photosensitive member possessing defects such as low sensitivity and poor durability.

As the organic photoconductive materials, a large number of azo pigments have been proposed since the azo pigments have excellent photoconductivity and are relatively readily produced by appropriately selecting an azo component and a coupler component which provide various electrophotographic characteristics. Such azo pigments have been disclosed in Japanese Laid-Open Patent Application Nos. 138646/1982, 202349/1982, 282743/1988, etc.

In recent years, however, a further improvement in electrophotographic characteristics such as the resultant image qualities and durability is required. Accordingly, with respect to the above-mentioned photosensitive member, there is still room for improvement in sensitivity and stability of electric potential in a repetitive use, etc.

SUMMARY OF THE INVENTION

An object of the present invention is to provide an electrophotographic photosensitive member including a photosensitive layer containing a novel organic photoconductive material.

Another object of the present invention is to provide an electrophotographic photosensitive member having high photosensitivity.

A further object of the present invention is to provide an electrophotographic photosensitive member which has excellent stability of electric potential upon repetitive use.

A still further object of the present invention is to provide an electrophotographic apparatus, a device unit and a facsimile machine, respectively including the electrophotographic photosensitive member.

According to the present invention, there is provided an electrophotographic photosensitive member, comprising: an electroconductive support and a photosensitive layer disposed on the electroconductive support, wherein the photosensitive layer comprises a triazene compound represented by the following formula (1):

$$-N{=}N-\overset{\overset{\displaystyle R}{|}}{N}-, \qquad (1)$$

wherein R denotes hydrogen, a substituted or unsubstituted alkyl group, a substituted or unsubstituted aryl group, or a substituted or unsubstituted aralkyl group.

According to the present invention, there is also provided an electrophotographic apparatus, a device unit and a facsimile machine including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
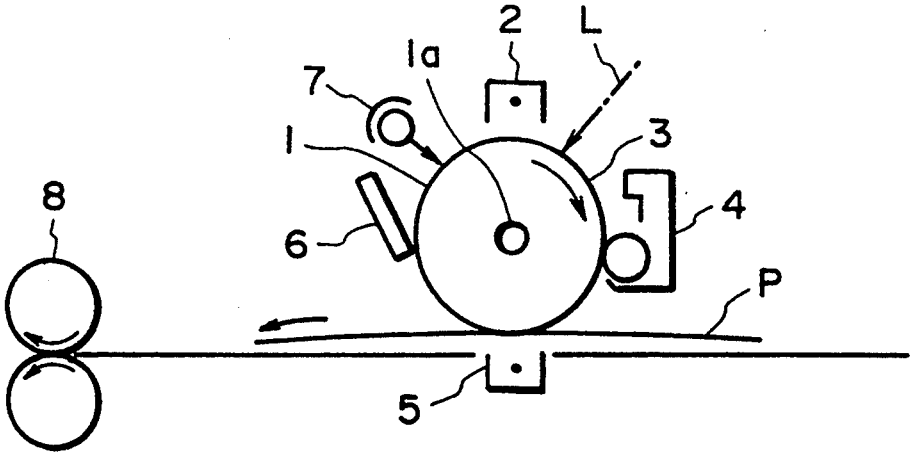
FIG. 1 is a schematic structural view of an electrophotographic apparatus using an electrophotographic photosensitive member according to the present invention.

The electrophotographic photosensitive member according to the present invention is characterized by a photosensitive layer comprising a triazene compound represented by the following formula (1):

$$-N{=}N-\overset{\overset{\displaystyle R}{|}}{N}-, \qquad (1)$$

wherein R denotes hydrogen, a substituted or unsubstituted alkyl group, a substituted or unsubstituted aryl group, or a substituted or unsubstituted aralkyl group.

In the above formula (1), specific examples of R may include: an alkyl group such as methyl, ethyl, or propyl; an aryl group such as phenyl, naphthyl, or anthryl; and an aralkyl group such as benzyl or phenethyl. Further, specific examples of a substituent contained in the substituted alkyl group and/or the substituted aryl group and/or the substituted aralkyl group may include: an alkyl group such as methyl, ethyl or propyl; halogen such as fluorine, chlorine, bromine or iodine; and acyl group such as acetyl or benzoyl; an alkylamino group such as dimethylamino or diethylamino; a phenylcarbamoyl group; a nitro group; a cyano group; and a haloalkyl group such as trifluoromethyl.

Preferred examples of the triazene compound of the formula (1) may include a triazene compound represented by the following formula (2):

$$Ar\text{-}(N{=}N{-}\overset{\overset{R}{|}}{N}{-}A)_n, \quad (2)$$

wherein Ar denotes a substituted or unsubstituted aryl group having a valence of n, or a substituted or unsubstituted aromatic heterocyclic group having a valence of n; R denotes hydrogen, a substituted or unsubstituted alkyl group, a substituted or unsubstituted aryl group, or a substituted or unsubstituted aralkyl group; A denotes a substituted or unsubstituted aryl group or a substituted or unsubstituted aromatic heterocyclic group; and n is 1, 2 or 3.

In the above formula (2), specific examples of Ar may include: those comprising an aryl group such as benzene, naphthalene, fluorene, phenanthrene, anthracene, or pyrene; those containing an aromatic heterocycle such as furan, thiophene, pyridine, indole, benzothiazole, carbazole, acridone, dibenzothiophene, benzoxazole, benzotriazole, oxadiazole, or thiazole; and those containing an aromatic ring formed by directly bonding or linking the above-mentioned compounds or formed by bonding or linking the above-mentioned compounds through one or more non-aromatic group, such as triphenylamine, diphenylamine, N-methyldiphenylamine, biphenyl, terphenyl, binaphthyl, biphenylphenylketone, fluorenone, dicyanofluorenylidene, phenanthrenequinone, anthraquinone, benzanthrone, 2,5-dibenzylidenecyclopentanone, 1,3-dibenzylidene-2-indanone, phenylbenzoxazole, diphenyloxadiazole, diphenyltriazole, phenyloxathiazole, diphenylmethane, dinaphthylethylene, diphenyl sulfone, diphenyl ether, benzophenone, stilbene, distyryl benzene, azobenzene, azoxybenzene, dibenzo-[a,c]-phenazine, α-cyanostilbene, triphenylmethane, tetraphenyl-p-phenylenediamine, tetraphenylbenzidine, or N-phenylphthalimide.

In the above formula (2), specific examples of R may include: an alkyl group such as methyl, ethyl, or propyl; an aryl group such as phenyl, naphthyl, or anthryl; and an aralkyl group such as benzyl or phenethyl.

In the above formula (2), specific examples of A may include those comprising an aryl group such as benzene, naphthalene, fluorene, phenanthrene, anthracene, or pyrene; those containing an aromatic heterocycle such as furan, thiophene, pyridyl-N-oxide, pyridine, indole, benzothiazole, carbazole, acridone, dibenzothiophene or benzoxazole; and those containing an aromatic ring formed by directly bonding or linking the above-mentioned compounds or formed by bonding or linking the above-mentioned compounds through one or more non-aromatic group, such as triphenylamine, diphenylamine, N-methyldiphenylamine, biphenyl, terphenyl, binaphthyl, fluorenone, phenanthrenequinone, anthraquinone, benzanthrone, 2,5-diphenyl-p-benzoquinone, benzophenone, azoxybenzene or azobenzene.

In the above formula (2), specific examples of a substituent contained in Ar, R and/or A may include: an alkyl group such as methyl, ethyl or propyl; halogen such as fluorine, chlorine, bromine or iodine; an acyl group such as acetyl or benzoyl; an alkylamino group such as dimethylamino or diethylamino; a phenylcarbamoyl group; a nitro group; a cyano group; and a haloalkyl group such as trifluoromethyl.

In the above formula (2), n may preferably be 2 or 3 in view of an enlargement of a conjugated system or crystallizability.

Hereinbelow, specific and non-exhaustive examples of the above-mentioned triazene compounds represented by the formulas (1) and (2) may preferably include those shown by the following structural formulas.

Formula (1):

$$-N{=}N{-}\overset{\overset{R}{|}}{N}{-}$$

Example Compound No. 1-1

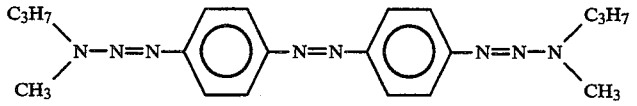

Example Compound No. 1-2

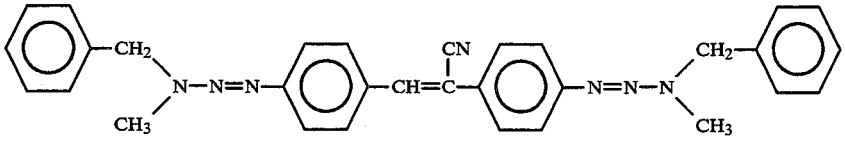

Formula (2):

$$Ar\text{-}(N{=}N{-}\overset{\overset{R}{|}}{N}{-}A)n$$

Ex.
Comp.

-continued
| No. | Ar | R | A |
|---|---|---|---|
| | (Case where n = 1, i.e., univalent Ar group) | | |
| 2-1 | 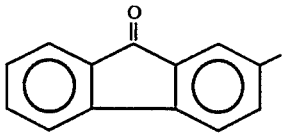 | —H | 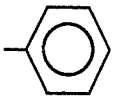 |
| 2-2 | 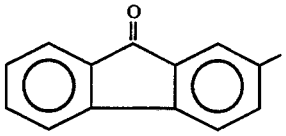 | —H | 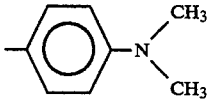 |
| 2-3 | 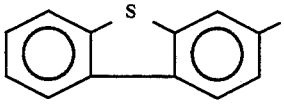 | —H | 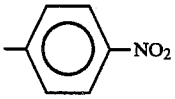 |
| 2-4 | 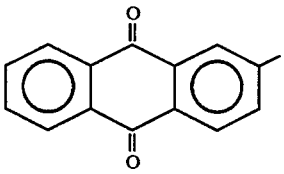 | —H | 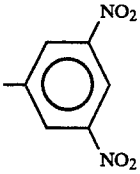 |
| 2-5 | 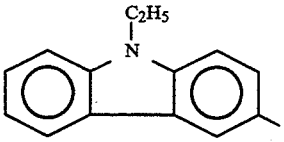 | —H | 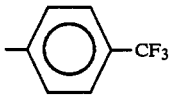 |
| 2-6 | 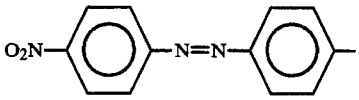 | 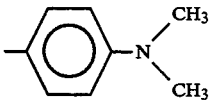 | 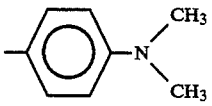 |
| 2-7 | 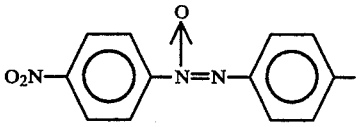 | —$CH_3$ | 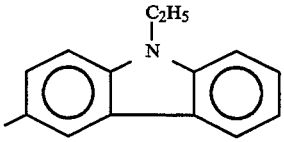 |
| 2-8 | 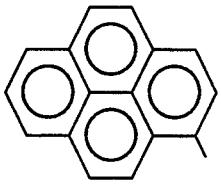 | —$CH_3$ | 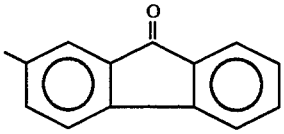 |
| 2-9 | 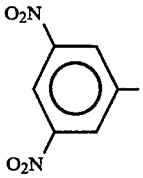 | 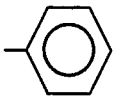 | 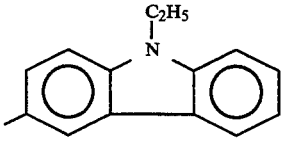 |
| 2-10 | 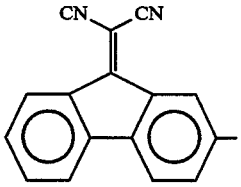 | 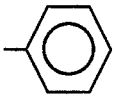 | 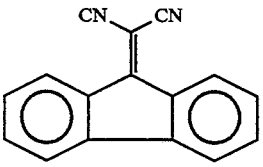 |

-continued
(Case where n = 2, i.e., bivalent Ar group)
| | | | |
|---|---|---|---|
| 2-11 | 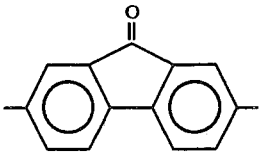 | —H | 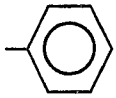 |
| 2-12 | 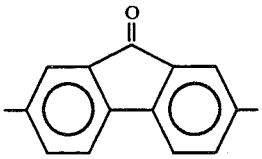 | —H | 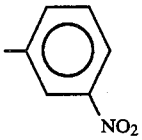 |
| 2-13 | 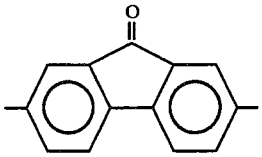 | —H | 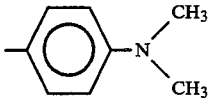 |
| 2-14 | 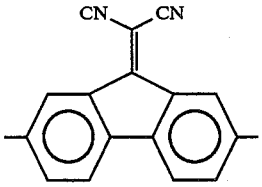 | —H | 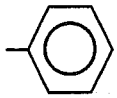 |
| 2-15 | 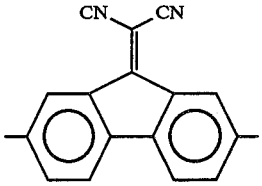 | —H | 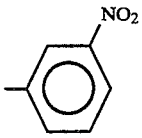 |
| 2-16 | 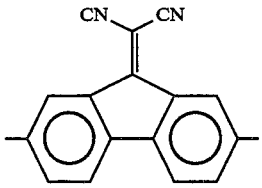 | —H | 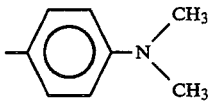 |
| 2-17 | 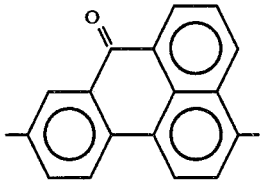 | —H | 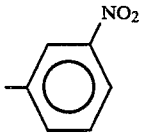 |
| 2-18 | 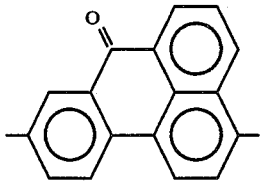 | —H | 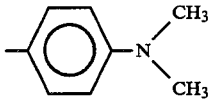 |

-continued
| | | | |
|---|---|---|---|
| 2-19 | 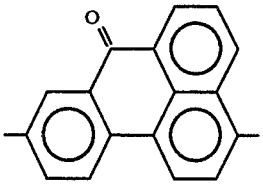 | $-CH_3$ | 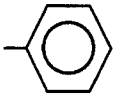 |
| 2-20 | 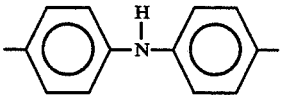 | $-H$ | 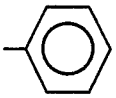 |
| 2-21 | 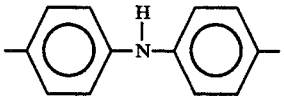 | $-H$ | 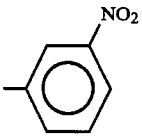 |
| 2-22 | 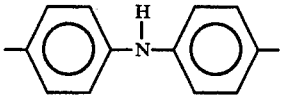 | $-CH_3$ | 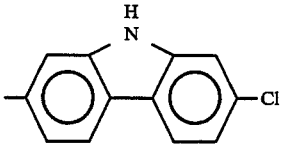 |
| 2-23 | 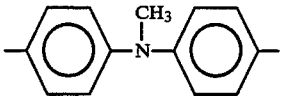 | $-H$ | 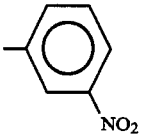 |
| 2-24 | 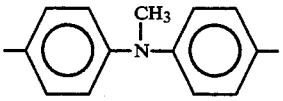 | $-H$ | 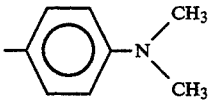 |
| 2-25 | 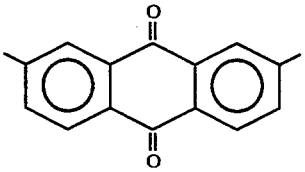 | $-H$ | 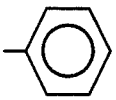 |
| 2-26 | 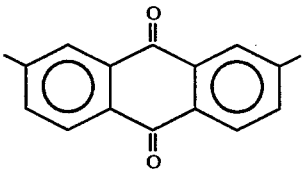 | $-H$ | 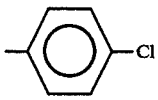 |
| 2-27 | 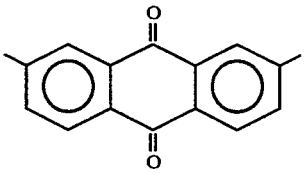 | 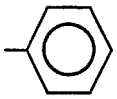 | 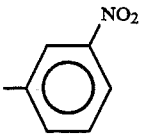 |
| 2-28 | 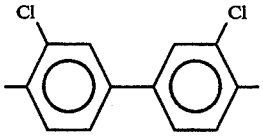 | $-H$ | 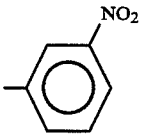 |

-continued
| | | | |
|---|---|---|---|
| 2-29 | 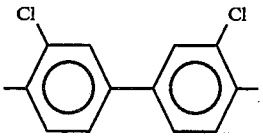 | —H | 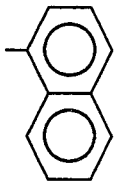 |
| 2-30 | 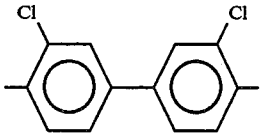 | $-C_2H_5$ | 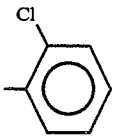 |
| 2-31 | 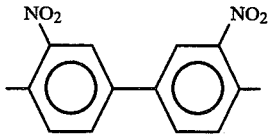 | —H | 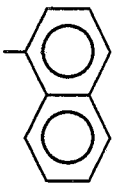 |
| 2-32 | 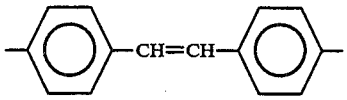 | —H | 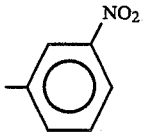 |
| 2-33 | 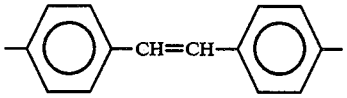 | 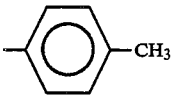 | 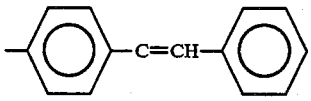 |
| 2-34 | 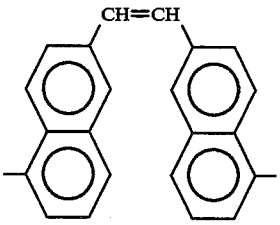 | 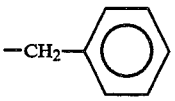 | 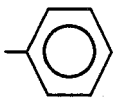 |
| 2-35 | 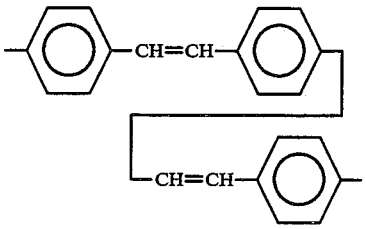 | —H | 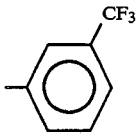 |
| 2-36 | 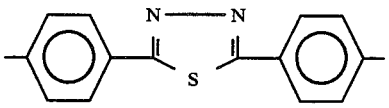 | —H | 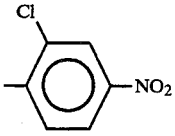 |
| 2-37 | 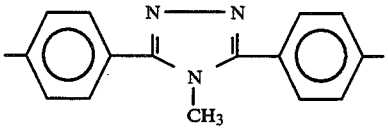 | —H | 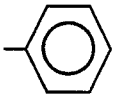 |

-continued
| | | | |
|---|---|---|---|
| 2-38 | 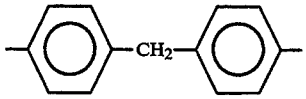 | 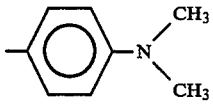 | 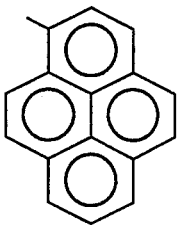 |
| 2-39 | 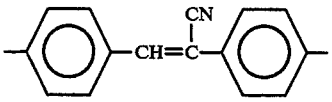 | —H | 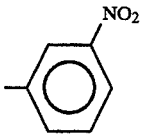 |
| 2-40 | 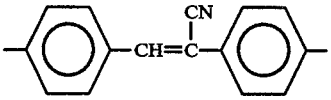 | —H | 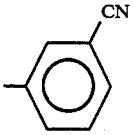 |
| 2-41 | 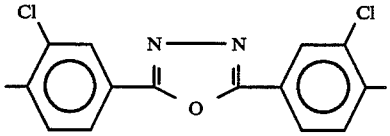 | —H | 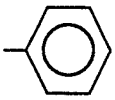 |
| 2-42 | 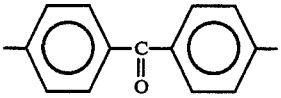 | —H | 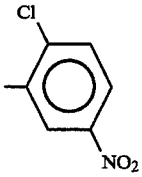 |
| 2-43 | 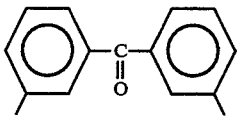 | $-C_3H_7$ | 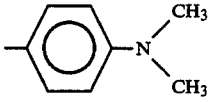 |
| 2-44 | 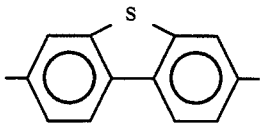 | 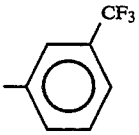 | 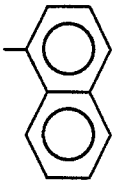 |
| 2-45 | 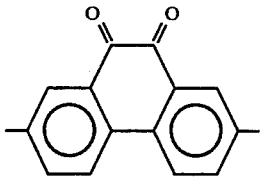 | —H | 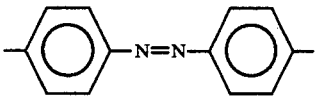 |
| 2-46 | 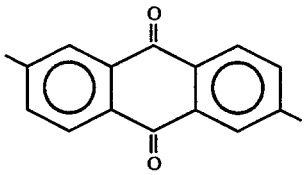 | —H | 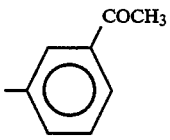 |

-continued
| | | | |
|---|---|---|---|
| 2-47 | 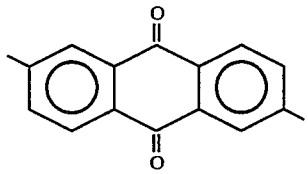 | —H | 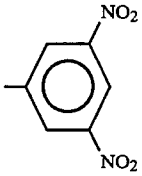 |
| 2-48 | 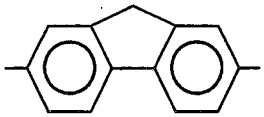 | 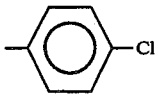 | 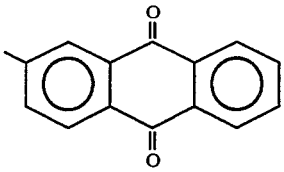 |
| 2-49 | 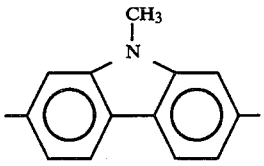 | —H | 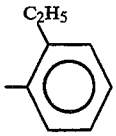 |
| 2-50 | 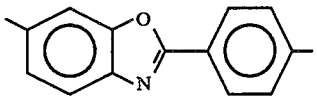 | —H | 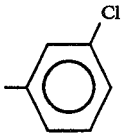 |
| 2-51 | 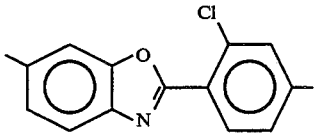 | —H | 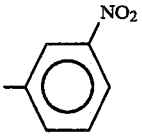 |
| 2-52 | 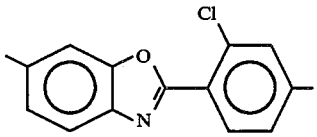 | —H | 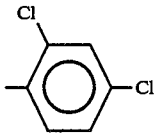 |
| 2-53 | 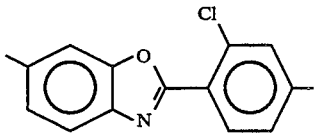 | 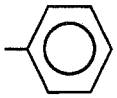 | 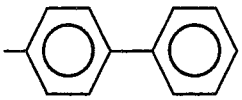 |
| 2-54 | 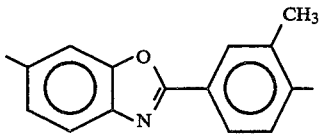 | —H | 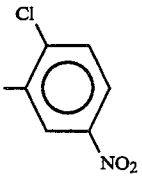 |
| 2-55 | 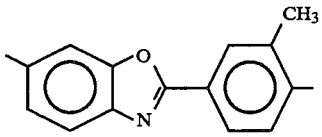 | —H | 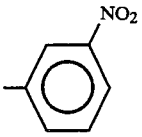 |
| 2-56 | 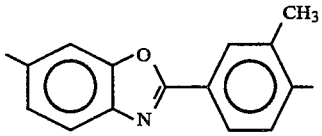 | —$CH_3$ | 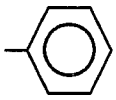 |

-continued
| | | | |
|---|---|---|---|
| 2-57 | 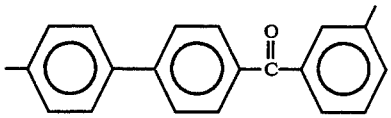 | —H | 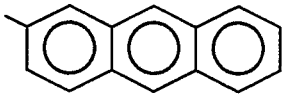 |
| 2-58 | 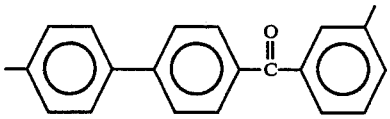 | —H | 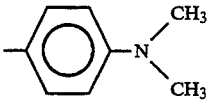 |
| 2-59 | 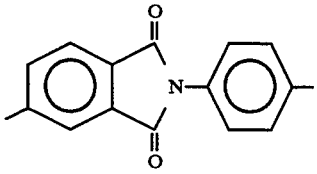 | —H | 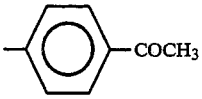 |
| 2-60 | 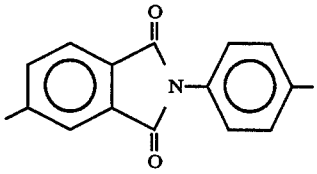 | 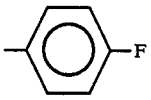 | 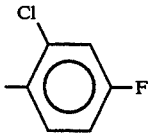 |
| 2-61 | 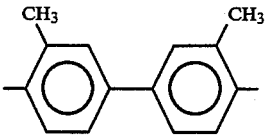 | —H | 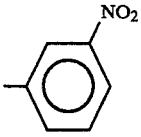 |
| 2-62 | 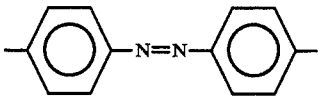 | —H | 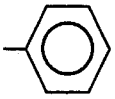 |
| 2-63 | 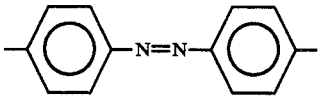 | —H | 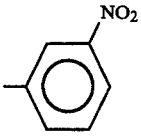 |
| 2-64 | 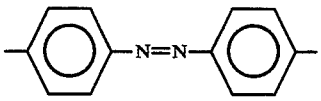 | 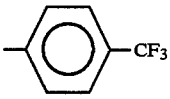 | 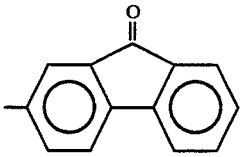 |
| 2-65 | 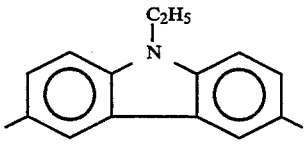 | —H | 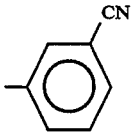 |
| 2-66 | 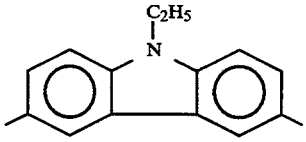 | —H | 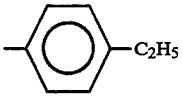 |
| 2-67 | 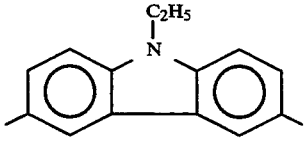 | —H | 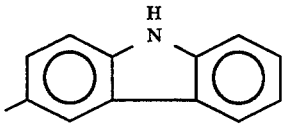 |

-continued
| | | | |
|---|---|---|---|
| 2-68 | 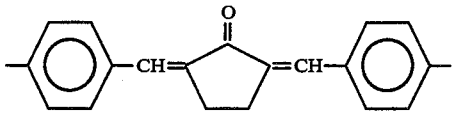 | —H | 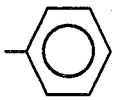 |
| 2-69 | 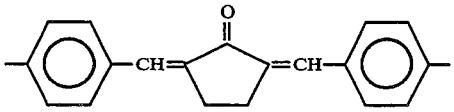 | —H | 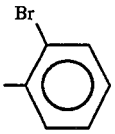 |
| 2-70 | 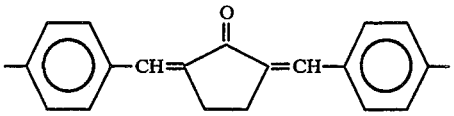 | —$CH_2Cl$ | 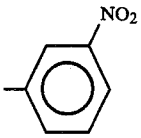 |
| 2-71 | 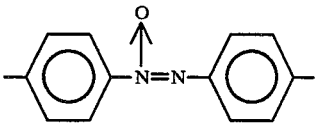 | —H | 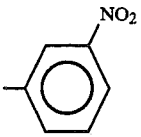 |
| 2-72 | 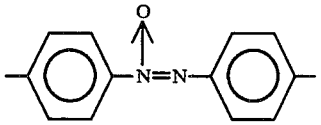 | —H | 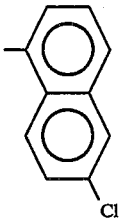 |
| 2-73 | 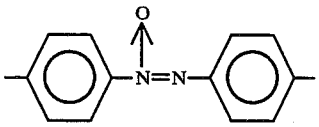 | —H | 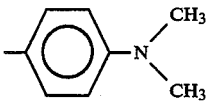 |
| 2-74 | 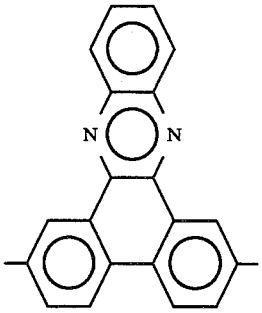 | —H | 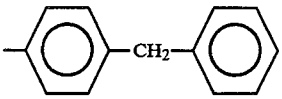 |
| 2-75 | 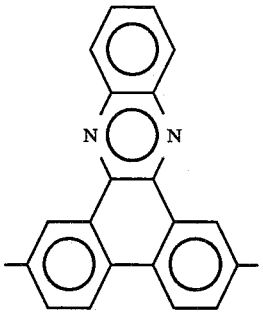 | —$C_2H_6$ | 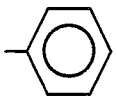 |

-continued
2-76
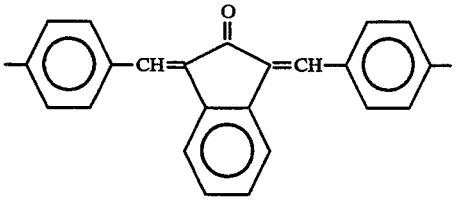
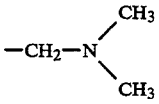
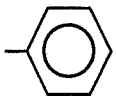
2-77
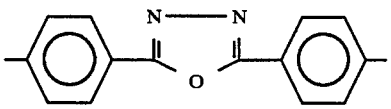
—H
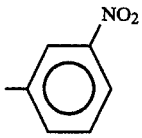
2-78
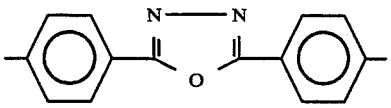
—H
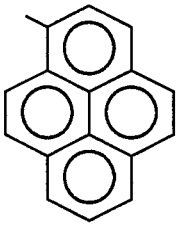
2-79
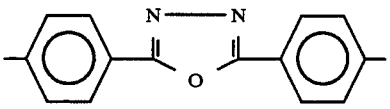
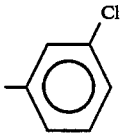
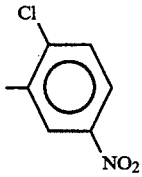
(Case where n = 3, i.e., trivalent Ar group)
2-80
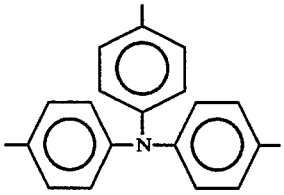
—H
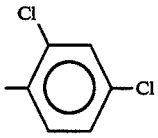
2-81
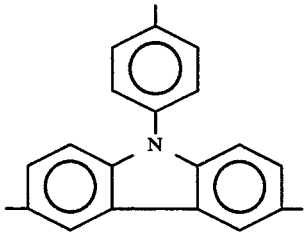
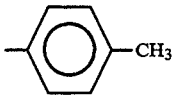
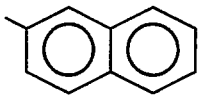
2-81
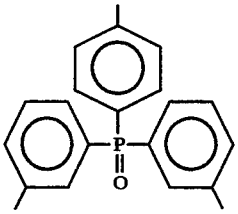
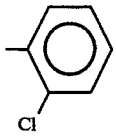
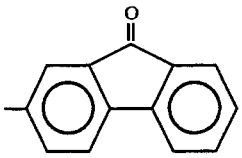

-continued

| | | | |
|---|---|---|---|
| 2-83 | 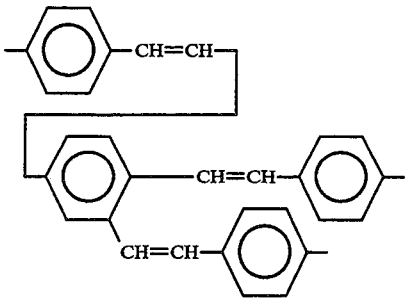 | —H | 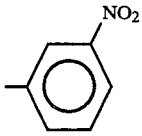 |
| 2-84 | 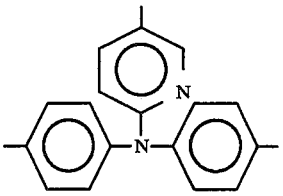 | —H | 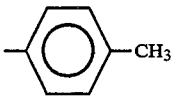 |
| 2-85 | 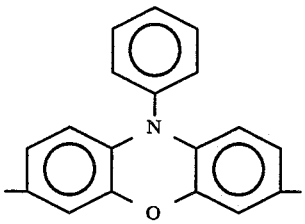 | —$CH_3$ | 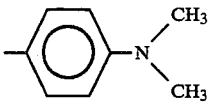 |
| 2-86 | 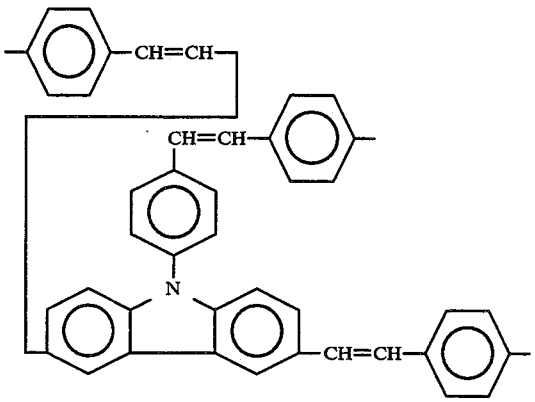 | —H | 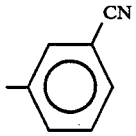 |

The above-mentioned triazene compounds of the formulas (1) and (2) may generally be synthesized by reacting a diazonium salt obtained from a corresponding amine with a primary or secondary amine in an aprotic solvent such as tetrahydrofuran (THF), N,N-dimethylformamide (DMF) or acetonitrile. In a case where R in the formulas (1) and (2) is hydrogen, it is possible to synthesize the triazene compounds of the formulas (1) and (2) by reacting a diazonium salt obtained from a corresponding amine with an imine in an organic solvent, such as acetonitrile, DMF, dichloromethane, acetic acid or nitromethane, which have been subjected to dehydration, and by adding water thereto to carry out hydrolysis.

Representative reaction schemes (a) and (b) showing the above-mentioned synthesis process are shown below.

Scheme A $$Ar\text{-}(\overset{+}{N}{=}N)_n.mX^{z-} + n(A{-}\overset{H}{\overset{|}{N}}R) \longrightarrow Ar\text{-}(N{=}N{-}\overset{R}{\overset{|}{N}}{-}A)_n$$

In the above, Ar, R, A and n are the same meanings as defined in the formula (2) and X denotes an anion. Further, m, n and z are 1, 2 or 3 and satisfy a relationship of: $n=m\times z$.

Scheme B $$Ar\text{-}(\overset{+}{N}{=}N)_n.mX^{z-} + n(A{-}N{=}\underset{R_2}{\underset{|}{C}}{-}R_1) \longrightarrow$$

-continued

Scheme B

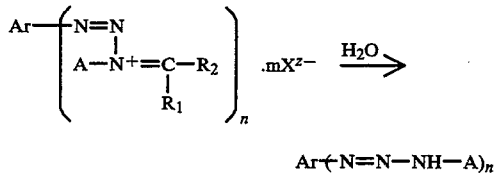

In the above, Ar, A, n, m, X and z are the same meanings as described in the scheme A. $R_1$ denotes hydrogen, an alkyl group, or a substituted or unsubstituted aryl group and $R_2$ denotes an alkyl group or a substituted or unsubstituted aryl group.

Synthesis Example (Production of Ex. Comp. 2-12)

In a 300 ml-beaker, 9.3 g (0.041M) of an amine compound of the following formula:

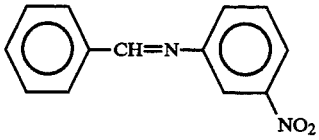

was dissolved in 90 ml of DMF, followed by cooling to 0° C. Then, 7.6 g (0.02M) of a diazonium salt of the following formula:

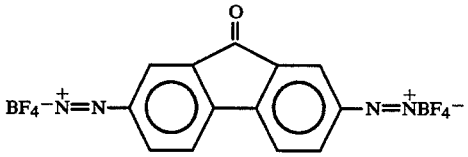

was added to the above solution, followed by stirring for 2 hours. After the reaction, the reaction mixture was added to 1.2 liters of ice water in 2 liter-beaker to precipitate a crystal. The crystal was recovered by filtration and dried under reduced pressure to obtain 7.0 g of an objective product (Yield: 72%), which showed the following results of elementary analysis.

| Elementary analysis | C (%) | H (%) | N (%) |
|---|---|---|---|
| Calculated value | 59.05 | 3.17 | 22.04 |
| Observed value | 59.38 | 3.05 | 22.41 |

The photosensitive member according to the present invention includes a photosensitive layer containing a triazene compound having a structure represented by the formula (1) disposed on an electroconductive support. In the present invention, the photosensitive layer may be formed in any known structure including a single layer structure and a laminated structure.

In a preferred embodiment of the present invention, the photosensitive layer may be function-separated into a charge generation layer and a charge transport layer (i.e., laminated structure), and the charge generation layer contains the above-mentioned triazene compound.

In the present invention, the charge generation layer may be formed by vapor-depositing the triazene compound on the electroconductive support or by dispersing the triazene compound in an appropriate solution containing a binder resin, applying the resultant coating liquid onto, e.g., the electroconductive support by means of a known coating method such as dipping, wire bar coating, spray coating or blade coating and then drying the coating. Examples of the binder resin used may be selected from various resins having insulating properties or organic photoconductive polymers and may preferably include polyvinyl butyral, polyvinyl benzal, polyarylate, polycarbonate, poyester phenoxy resins, cellulosic resins, acrylic resins and polyurethane. Examples of the solvent used may be selected from those dissolving the above-mentioned binder resin and may preferably include: ethers such as tetrahydrofuran and 1,4-dioxane; ketones such as cyclohexanone and methyl ethyl ketone; amines such as N,N-dimethylformamide; esters such as methyl acetate and ethyl acetate; aromatic compounds such as toluene, xylene and chlorobenzene; alcohols such as methanol, ethanol and 2-propanol; and aliphatic halogenated hydrocarbons such as chloroform, methylene chloride, dichloroethylene, carbon tetrachloride and trichloroethylene. The solvent may preferably be selected from those which do not substantially dissolve the charge transport layer or a primer (or undercoating) layer described hereinafter.

The charge transport layer used in the invention contains a charge-transporting material having the function of receiving charge carriers from the charge generation layer and transporting the charge carriers under an electric field. The charge-transporting material includes an electron-transporting material and a hole-transporting material.

Examples of the electron-transporting material may include: an electron attractive substance such as 2,4,7-trinitrofluorenone, 2,4,5,7-tetranitrofluorenone, chloranil or tetracyanoquinonedimethane; and polymers of these substances. Examples of the hole-transporting material may include: polycyclic aromatic compounds such as pyrene and anthracene; heterocyclic compounds such as carbazoles, indoles, imidazole, oxazoles, thiazoles, oxadiazoles, pyrazoles, pyrazolines, thiadiazoles and triazole; hydrazone compounds such as p-diethylaminobenzaldehyde-N,N-diphenylhydrazone and N,N-diphenylhydrazino-3-methylidene-9-ethylcarbazole; styryl-type compounds such as α-phenyl-4'-N,N-diphenylaminostilbene and 5-[4-(di-p-tolylamino)-benzylidene]-5H-dibenzo-[a,d]-cycloheptene; benzidines; triarylmethanes; triarylamines such as tri(p-tolyl)amine, 2-[di-(p-tolyl)]amino-9,9'-dimethylfluorenone, 4-[di-(p-tolyl)]aminobiphenyl and 1-[di-(-tolyl)]aminopyrene; and polymers having a group containing the above-mentioned compounds at a main chain or a lateral chain, such as poly-N-vinylcarbazole. It is possible to use inorganic materials such as selenium, selenium-tellurium, amorphous silicon and cadmium sulfide as the charge-transporting material. The above-mentioned charge-transporting material may be used singly or in combination of two or more species. When the charge-transporting material does not have film-forming properties, it is possible to use an appropriate binder resin together therewith.

The charge transport layer according to the present invention may preferably be formed by dissolving the above-mentioned triazene compound of the formula (1) in an appropriate solvent together with the binder resin, applying the resultant coating liquid such as solution onto a predetermined surface (e.g., the surface of an electroconductive substrate, charge generation layer, etc.) by the above-mentioned coating method, and then drying the resultant coating.

Examples of the binder resin to be used for forming the charge transport layer may include: insulating polymers such as acrylic resins, polyarylate, polyester, polycarbonate, polystyrene, acrylonitrile-styrene copolymers, polyacrylamide, polyamide and chlorinated rubber; and organic photoconductive polymers such as poly-N-vinylcarbazole and polyvinylanthracene.

In another embodiment of the present invention, the photosensitive layer may be composed of a single layer comprising the above-mentioned triazene compound and the above-mentioned charge-transporting material. In this instance, it is possible to use a charge transfer complex comprising poly-N-vinylcarbazole and trinitrofluorenone as the charge-transporting material. The photosensitive layer may be formed by dispersing the triazene compound and the charge transfer complex in an appropriate solvent together with a binder resin, applying the resultant coating liquid onto the electroconductive support by the above-mentioned coating method and then drying the coating.

In this instance, examples of the solvent used and the binder resin used may include those described hereinabove.

In formulating the photosensitive layer, when the photosensitive layer is composed of a single layer, the charge-generating material and the charge-transporting material may preferably be contained in the photosensitive layer in amounts of 2–20 wt. % and 30–80 wt. %, respectively, particularly 2–10 wt. % and 40–70 wt. %, respectively. When the photosensitive layer has a laminated structure, the charge-generating material may preferably be contained in the charge generation layer in an amount of 20–80 wt. %, particularly 50–70 wt. %, and the charge-transporting material may preferably be contained in the charge transport layer in an amount of 30–70 wt. %, particularly 40–60 wt. %.

The thickness of the photosensitive layer which is composed of a single layer may preferably be 5–40 microns, more preferably 15–30 microns. When the photosensitive layer has a laminated structure, the thickness of the charge generation layer may preferably be 0.01–5 microns, more preferably 0.1–1 micron, and the thickness of the charge transport layer may preferably be 5–40 microns, more preferably 15–30 microns.

In any photosensitive member according to the present invention, the triazene compound having the formula (1) may be crystalline or amorphous, preferably crystalline. Further, it is possible to use the triazene compound of the formula (1) in combination with at least one another triazene compound of the formula (1) or a known charge-generating material.

The electroconductive support used in the present invention may include aluminum, aluminum alloy, copper, zinc, stainless steel, vanadium, molybdenum, chlomium, titanium, nickel, indium, gold and platinum. The electroconductive support may also include: a plastic (such as polyethylene terephthalate or acrylic resins) coated with, e.g., a vacuum vapor-deposited layer of the above-mentioned metal or alloy; a plastic, metal or alloy coated with a layer comprising a mixture of an electroconductive powder (such as carbon black or silver particles) and an appropriate binder resin; and a plastic or paper impregnated with electroconductive particles. The electroconductive support may be in any form such as drum, sheet, film, belt, etc., and may preferably assume a shape adapted to an electrophotographic apparatus to be used therewith.

In the present invention, between the electroconductive substrate and the photosensitive layer, there can be formed a primer or undercoat layer having a barrier function and an adhesive function. The primer layer may comprise, e.g., casein, polyvinyl alcohol, nitrocellulose, polyamide (e.g., nylon 6, nylon 66, nylon 610, copolymer nylon, alkoxymethylated nylon, etc.), polyurethane or aluminum oxide. The thickness of the primer layer may preferably be at most 5 microns, particularly 0.1 to 3 microns.

In order to protect the photosensitive layer from external mechanical shock or external chemical action, a protective layer can further be disposed on the photosensitive layer. Such a protective layer may comprise a resin, or a resin containing conductive particles or a charge-transporting material.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, a liquid crystal printer, and other fields of applied electrophotography including, e.g., laser plate making.

FIG. 1 shows a schematic structural view of an electrophotographic apparatus using an electrophotographic photosensitive member of the invention. Referring to FIG. 1, a photosensitive drum (i.e., photosensitive member) 1 as an image-carrying member is rotated about an axis 1*a* at a prescribed peripheral speed in the direction of the arrow shown inside of the photosensitive drum 1. The surface of the photosensitive drum is uniformly charged by means of a charger 2 to have a prescribed positive or negative potential. The photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member (photosensitive drum), the charger, the developing means, the cleaner, etc. so as to be attached or removed as desired.

The device unit may, for example, be composed of the photosensitive member and at least one device of the charger, the developing means and the cleaner to prepare a single unit capable of being attached to or removed from the body of the electrophotographic apparatus by using a guiding means such as a rail in the body. The device unit can be accompanied with the charger and/or the developing means to prepare a single unit.

In case where the electrophotographic apparatus is used as a copying machine or a printer, exposure light-image L may be given by reading a data on reflection light or transmitted light from an original or on the original, converting the data into a signal and then effecting a laser beam scanning, a drive of LED array or a drive of a liquid crystal shutter array so as to expose the photosensitive member with the light-image L.

Figure 2:
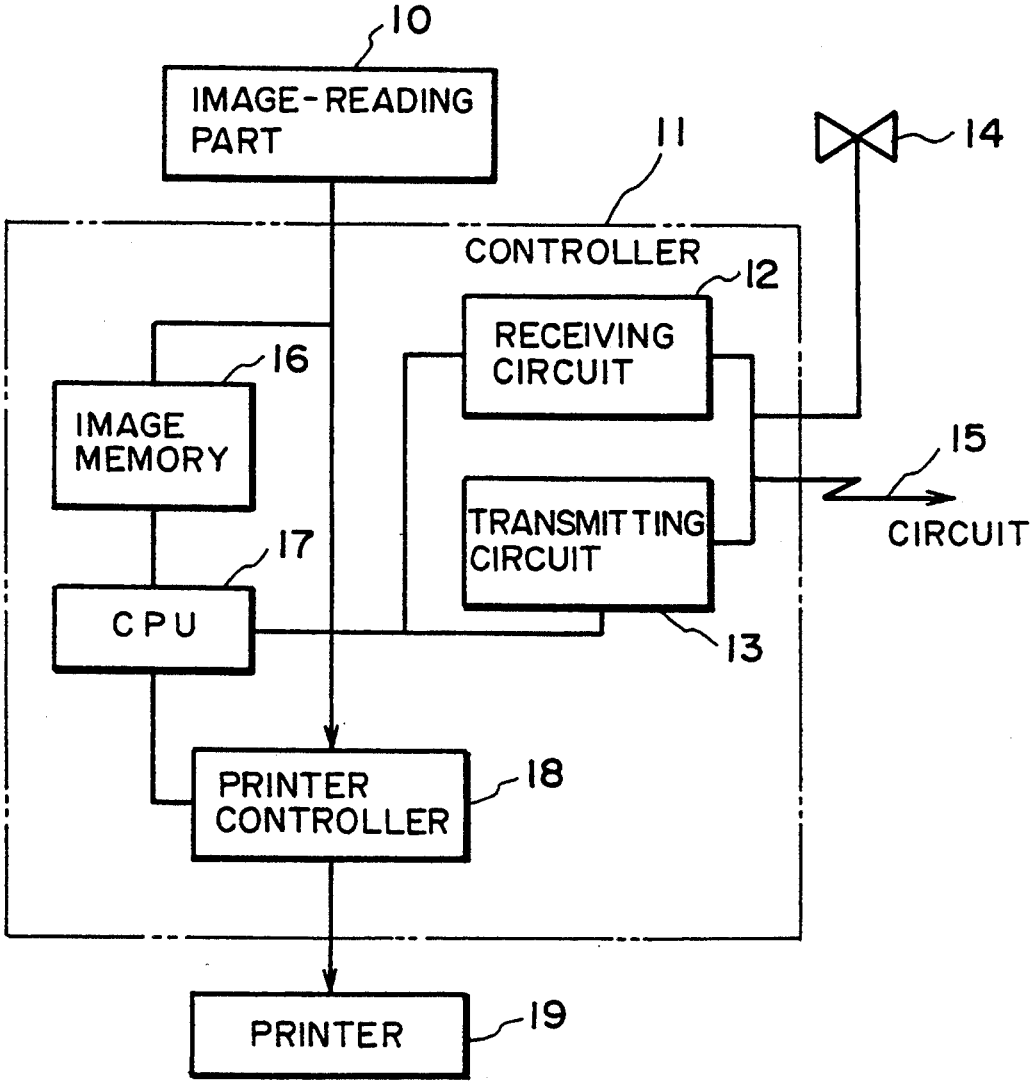
FIG. 2 is a block diagram of a facsimile machine using an electrophotographic apparatus according to the present invention as a printer.

In case where the electrophotographic apparatus according to the present invention is used as a printer of a facsimile machine, exposure light-image L is given by exposure for printing received data. FIG. 2 shows a block diagram of an embodiment for explaining this case. Referring to FIG. 2, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory memorizes prescribed image data. A printer controller 18 controls the printer 19, and a reference numeral 14 denotes a telephone handset.

The image received through a circuit 15 (the image data sent through the circuit from a connected remote terminal) is demodulated by means of the receiving circuit 12 and successively stored in an image memory 16 after a restoring-signal processing of the image data. When an image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive image for a subsequent page during the recording by the printer 19. As described above, the receiving and recording of the image are performed.

Hereinbelow, the present invention, will be explained more specifically with reference to examples.

EXAMPLE 1

Onto an aluminum plate, a solution of 5 g of an N=methoxymethylated 6-nylon resin (Mn (number-average molecular weight)=32,000) and 10 g of an alcohol-soluble copolymer nylon resin (Mn=29,000) in 95 g of methanol was applied by means of a wire bar, followed by drying to form a 1 micron-thick undercoating layer.

Separately, 5 g of a triazene compound (Example Compound No. 2-12) was added to a solution of 2 g of polyvinylbenzal (benzal degree=75%, Mn=70,000) in 95 g of cyclohexanone and the resultant mixture was dispersed for 20 hours by means of a sand mill to prepare a coating liquid. The coating liquid was applied onto the above-prepared undercoating layer formed on the aluminum plate by means of a wire bar to form a charge generation layer having a thickness (after drying) of 0.2 micron.

Then, 5 g of a styryl compound of the formula:

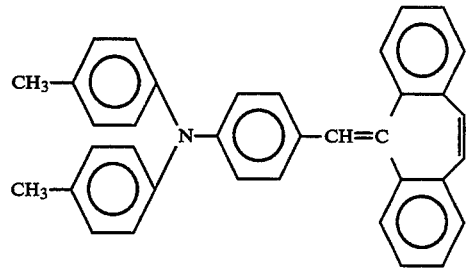

and 5 g of polymethylmethacrylate (Mn=100,000) were dissolved in 40 g of chlorobenzene to prepare a coating liquid.

The coating liquid was applied onto the above-mentioned charge generation layer by means of a wire bar to form a charge transport layer having a thickness (after drying) of 20 microns, whereby an electrophotographic photosensitive member was prepared.

The thus prepared photosensitive member was negatively charged by using corona (−5 KV) according to a static method by means of an electrostatic copying paper tester (Model: SP-428, mfd. by Kawaguchi Denki K. K.) and retained in a dark place for 1 sec. Thereafter, the photosensitive member was exposed to light at an illuminance of 10 lux by means of a halogen lamp, to evaluate the charging characteristic. In order to evaluate the charging characteristic, the surface potential ($V_O$), the (dark part) potential ($V_D$) obtained after a dark decay of 1 sec, and the exposure quantity ($E_{\frac{1}{2}}$) (i.e., sensitivity) required for decreasing the potential $V_D$ to $\frac{1}{2}$ thereof were measured.

The results are shown in Table 1 appearing hereinafter.

EXAMPLES 2–7

Six species of photosensitive members were prepared and evaluated in the same manner as in Example 1 except that the triazene compounds shown in Table 1 below were used instead of the triazene compound (Ex. Comp. No. 2-12), respectively. The results are shown in the following Table 1.

TABLE 1

| Ex. No. | Ex. Comp. No. | $V_O$ (V) | $V_D$ (V) | $E_{\frac{1}{2}}$ (lux.sec) |
|---|---|---|---|---|
| 1 | 2-12 | −720 | −710 | 3.15 |
| 2 | 2-15 | −680 | −675 | 1.92 |
| 3 | 2-17 | −710 | −700 | 1.37 |
| 4 | 2-43 | −660 | −655 | 4.23 |
| 5 | 2-68 | −700 | −695 | 3.16 |
| 6 | 2-72 | −730 | −715 | 1.44 |
| 7 | 2-79 | −710 | −700 | 1.50 |

Comparative Examples 1 and 2

Two species of photosensitive members were prepared and evaluated in the same manner as in Example 1 except that the following comparative compounds (1) and (2) were used instead of the triazene compound (Ex. Comp. No. 2-12), respectively.

(Comparative Compound (1))

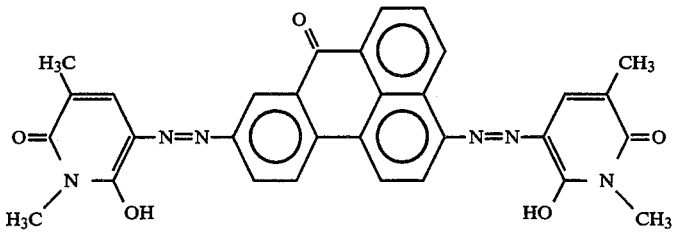

(Comparative Compound (2))

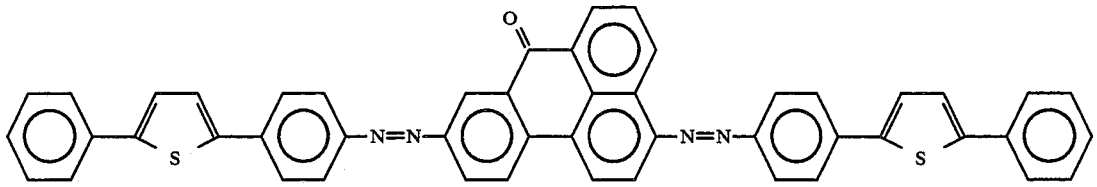

The results are shown in the following Table 2.

TABLE 2

| Ex. Comp. No. | Comp. Comp No. | $V_O$ (V) | $V_D$ (V) | $E_{\frac{1}{2}}$ (lux.sec) |
|---|---|---|---|---|
| 1 | (1) | −620 | −605 | 8.75 |
| 2 | (2) | −570 | −550 | 9.31 |

EXAMPLES 8–10

Three species of the photosensitive members prepared in Examples 1–3 were bonded to the cylinder for a photosensitive drum to be used for an electrophotographic copying apparatus equipped with a corona charger (−6.5 KV), an exposure optical system, a developing means, a transfer charger, an exposure optical system for erasing residual charge, and a cleaner. After a dark part potential ($V_D$) and a light part potential ($V_L$) at the initial stage were set to −700 V and −200 V, respectively, the electrophotographic copying apparatus was subjected to a copying test (a durability test) of 5,000 sheets. Thus, $V_D$ and $V_L$ were measured after the copying test of 5,000 sheets to evaluate variations in these potentials ($\Delta V_D$ and $\Delta V_L$).

The results are shown in Table 3 below. In Table 3, a negative value means a decrease in an absolute value of $V_D$ and a positive value means an increase in an absolute value of $V_L$.

TABLE 3

| Ex. No. | Ex. Comp. No. | $\Delta V_D$ (V) | $\Delta V_L$ (V) |
|---|---|---|---|
| 8 | 2-12 | −5 | +5 |
| 9 | 2-15 | −10 | 0 |
| 10 | 2-17 | 0 | +20 |

Comparative Example 3

The photosensitive member was evaluated in the same manner as in Examples 8–10, whereby the following results were obtained.

$\Delta V_D$:−210 V, $\Delta V_L$:+120 V

EXAMPLE 11

A 0.5 micron-thick undercoating layer of polyvinylalcohol (Mn=50,000) was formed on an aluminum-deposited polyethylene terephthalate film. Separately, 5 g of a triazene compound (Ex. Comp. No. 2-46) was added to a solution of 2 g of polyvinylbutyral (butyral degree=63 mol. %, Mn=75,000) in 95 g of cyclohexanone and the resultant mixture was dispersed for 20 hours by means of a sand mill to prepare a coating liquid. The coating liquid was applied onto the above-prepared undercoating layer and dried to form a 0.2 micron-thick charge generation layer.

Then, 5 g of a hydrazone compound of the formula:

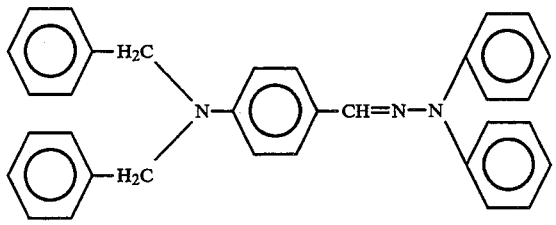

and 5 g of a bisphenol Z-type polycarbonate resin (Mw (weight-average molecular weight)=55,000) were dissolved in 40 g of tetrahydrofuran (THF) to prepare a coating liquid. The coating liquid was applied onto the above-mentioned charge generation layer and dried to form a 20 micron-thick charge transport layer, whereby an electrophotographic photosensitive layer was prepared.

The thus prepared photosensitive member was subjected to evaluation of the charging characteristic and the durability characteristic in the same manner as in Examples 1 and 8–10.

The results are shown below.

$V_O$:−750 V, $V_D$:−740 V, $E_{\frac{1}{2}}$:3.92 lux.sec $\Delta V_D$:−10 V, $\Delta V_L$:+5 V

EXAMPLE 12

A 0.5 micron-thick undercoating layer of polyvinylalcohol (Mn=50,000) was formed on an aluminum-deposited polyethylene terephthalate film. Separately, 5 g of a triazene compound (Ex. Comp. No. 2-72) was added to a solution of 2 g of poly-p-fluorovinylbenzal (benzal degree=75 mol. %, Mn=80,000) in 95 g of THF and the resultant mixture was dispersed for 20 hours by means of a sand mill to prepare a coating liquid. The coating liquid was applied onto the above-prepared undercoating layer and dried to form a 0.2 micron-thick charge generation layer.

Then, 5 g of a triarylamine compound of the formula:

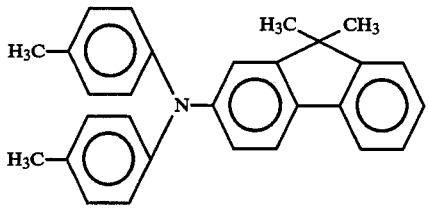

and 5 g of a bisphenol Z-type polycarbonate resin (Mw=55,000) were dissolved in 40 g of chlorobenzene to prepare a coating liquid. The coating liquid was applied onto the above-mentioned charge generation layer and dried to form a 20 micron-thick charge transport layer, whereby an electrophotographic photosensitive layer was prepared.

The thus prepared photosensitive member was subjected to evaluation of the charging characteristic and the durability characteristic in the same manner as in Examples 1 and 8–10.

The results are shown below.

$V_O$:−690 V, $V_D$:−685 V, $E_{\frac{1}{2}}$:2.33 lux.sec $\Delta V_D$:0 V, $\Delta V_L$:+10 V

EXAMPLE 13

An electrophotographic photosensitive was prepared in the same manner as in Example 3 except that the charge generation layer and the charge transport layer was prepared in reverse order. The above-prepared photosensitive member was evaluated in the same manner as in Examples 1 and 8–10 except that the photosensitive member was positively charged, whereby the following results were obtained.

$V_O$+670 V, $V_D$:+665 V, $E_{\frac{1}{2}}$:1.87 lux.sec $\Delta V_D$:−20 V, $\Delta V_L$:0 V

EXAMPLE 14

Up to a charge generation layer was prepared in the same manner as in Example 1. Onto the charge generation layer, a solution of 5 g of 2,4,7-trinitro-9-fluorenone and 5 g of a bisphenol A-type polycarbonate resin (Mw=30,000) in 50 g of THF was applied by means of a wire bar to form a charge generation layer having a thickness (after drying) of 18 microns, whereby an electrophotographic photosensitive member was prepared.

The thus prepared photosensitive member was evaluated in the same manner as in Example 1 except that the photosensitive member was positively charged, whereby the following results were obtained.

$V_O$:+675 V, $V_D$:+660 V, $E_{\frac{1}{2}}$:3.01 lux.sec

EXAMPLE 15

0.5 g of a triazene compound (Ex. Comp. No. 2-12) and 9.5 g of cyclohexanone were dispersed for 5 hours by means of a paint shaker. To the resultant dispersion, a solution of 5 g of a styryl compound used in Example 1 and 5 g of a bisphenol Z-type polycarbonate resin in 40 g of THF was added, followed by a shake for 1 hour to prepare a coating liquid. The coating liquid was applied onto an aluminum support by means of a wire bar and dried to form a 20 micron-thick photosensitive layer, whereby an electrophotographic photosensitive member was prepared.

The thus prepared photosensitive member was evaluated in the same manner as in Example 1 except that the photosensitive member was positively charged, whereby the following results were obtained.

$V_O$:+710 V, $V_D$:+700 V, $E_{\frac{1}{2}}$:4.27 lux.sec

EXAMPLE 16

An electrophotographic photosensitive member was prepared in the same manner as in Example 1 except for using a triazene compound (Ex. Comp. No. 1-2) instead of the triazene compound (Ex. Comp. No. 2-12).

The thus prepared photosensitive member was evaluated in the same manner as in Examples 1 and 8–10, whereby the following results were obtained.

$V_O$:−700 V, $V_D$:−690 V, $E_{\frac{1}{2}}$:2.16 lux.sec $\Delta V_D$:−10 V, $\Delta V_L$:+10 V

EXAMPLE 17

An electrophotographic photosensitive member was prepared in the same manner as in Example 1 except for using a triazene compound (Ex. Comp. No. 2-80) instead of the triazene compound (Ex. Comp. No. 2-12).

The thus prepared photosensitive member was evaluated in the same manner as in Examples 1 and 8–10, whereby the following results were obtained.

$V_O$:−690 V, $V_D$:−685 V, $E_{\frac{1}{2}}$:1.48 lux.sec $\Delta V_D$:−5 V, $\Delta V_L$:+5 V

What is claimed is:

1. An electrophotographic photosensitive member, comprising: an electroconductive support and a photosensitive layer disposed on the electroconductive support, wherein the photosensitive layer comprises a triazene compound represented by the following formula (2):

$$Ar-(N{=}N-\overset{\overset{\displaystyle R}{|}}{N}-A)_n$$

wherein Ar is a substituted or unsubstituted aryl group having a valence of n, or a substituted or unsubstituted aromatic heterocyclic group having a valence of n; R is hydrogen, a substituted or unsubstituted alkyl group, a substituted or unsubstituted aryl group, or a substituted or unsubstituted aralkyl group; A is a substituted or unsubstituted aryl group or a substituted or unsubstituted aromatic heterocyclic group; and n is 2 or 3.

2. A photosensitive member according to claim 1, wherein the photosensitive layer comprises the triazene compound represented by the formula (2) as a charge-generating material.

3. A photosensitive member according to claim 1, wherein the photosensitive layer comprises a charge generation layer and a charge transport layer.

4. A photosensitive member according to claim 3, comprising the electroconductive support, the charge generation layer and the charge transport layer in this order.

5. A photosensitive member according to claim 3, comprising the electroconductive support, the charge transport layer and the charge generation layer in this order.

6. A photosensitive member according to claim 1, wherein the photosensitive layer is formed in a single layer.

7. A photosensitive member according to claim 1, wherein an undercoating layer is disposed between the electroconductive support and the photosensitive layer.

8. A photosensitive member according to claim 1, wherein a protective layer is disposed on the photosensitive layer.

9. An electrophotographic apparatus, comprising: an electrophotographic photosensitive member according to claim 1, means for forming an electrostatic latent image, means for developing the formed electrostatic latent image and means for transferring the developed image to a transfer-receiving material.

10. A device unit, including: an electrophotographic photosensitive member according to claim 1 and at least one means selected from a charging means, a developing means, and a cleaning means;

wherein said photosensitive member, and said at least one means selected from the charging means, the developing means, and the cleaning means are integrally supported to form a single unit, which can be connected to or released from an apparatus body as desired.

11. A facsimile machine, comprising: an electrophotographic apparatus and means for receiving image data from a remote terminal, the electrophotographic apparatus including an electrophotographic photosensitive member according to claim 1.

* * * * *

UNITED STATES PATENT AND TRADEMARK OFFICE

CERTIFICATE OF CORRECTION

PATENT NO. : 5,356,746

DATED : October 18, 1994

INVENTOR(S) : SATOMI SUGIYAMA, ET AL.

It is certified that error appears in the above-identified patent and that said Letters Patent is hereby corrected as shown below:

COLUMN 9

Formula 2-22, "H should read --H
N" N--.

COLUMN 26

Line 8, "poyester" should read --polyester--.

COLUMN 27

Line 57, "chlo-" should read --chro- --.
Line 60, "polyethylene terephthalate" should read --polyethylene, polypropylene, polyvinyl chloride, polyethylene terephthalate--.

COLUMN 33

Line 37, "photosensitive" should read --photosensitive member--.
Line 53, "Up to a" should read --A--.

Signed and Sealed this

Second Day of May, 1995

Bruce Lehman

BRUCE LEHMAN

*Commissioner of Patents and Trademarks*

*Attest:*

*Attesting Officer*